US005307085A

United States Patent [19]

Nakamura

[11] Patent Number: 5,307,085

[45] Date of Patent: Apr. 26, 1994

[54] DISPLAY APPARATUS HAVING SHIFT REGISTER OF REDUCED OPERATING FREQUENCY

[75] Inventor: Tadashi Nakamura, Tokyo, Japan

[73] Assignee: NEC Corporation, Tokyo, Japan

[21] Appl. No.: 958,256

[22] Filed: Oct. 8, 1992

[30] Foreign Application Priority Data

Oct. 8, 1991 [JP] Japan ..... 3-260188

[51] Int. Cl.[5] ..... G09G 3/00

[52] U.S. Cl. ..... 345/99; 345/200; 345/204

[58] Field of Search ..... 340/799, 781, 784, 800, 340/802, 811, 814; 345/98, 99, 100, 213, 185, 196, 200, 204

[56] References Cited

U.S. PATENT DOCUMENTS 4,149,151 4/1979 Nagal et al. .
4,824,212 4/1989 Taniguchi ..... 340/784
4,908,710 3/1990 Wakai et al. ..... 340/799
5,010,325 4/1991 Ziuchkovski ..... 340/781

FOREIGN PATENT DOCUMENTS 2135099 8/1984 United Kingdom .
2170033 7/1986 United Kingdom .

*Primary Examiner*—Alvin E. Oberley
*Assistant Examiner*—Steven J. Saras

[57] ABSTRACT

In a dynamic drive type matrix display apparatus having a scan drive circuit for sequentially driving a number of scan electrodes of a display panel and a data drive circuit for simultaneously driving a number of data electrodes of the display panel, the data drive circuit is divided into a plurality of data drive sub-circuits, and data of one scan to be transferred to a shifter register of each of the data drive sub-circuits is stored in a memory circuit once, and thereafter, simultaneously transferred in parallel to the shift registers of all the data drive sub-circuits.

3 Claims, 3 Drawing Sheets

DISPLAY APPARATUS HAVING SHIFT REGISTER OF REDUCED OPERATING FREQUENCY

BACKGROUND OF THE INVENTION

1. Field Of The Invention

The present invention relates to a display apparatus, and more specifically to a data transfer system for transferring data to a data drive circuit of a dynamic drive type display apparatus.

2. Description Of Related Art

A typical conventional display apparatus includes a signal control circuit receiving a vertical synchronizing signal and a horizontal synchronizing signal and generating a scan control signal, a driver signal and a latch signal. In response to the scan control signal, a scan drive circuit sequentially drives a number of scan electrodes of a display panel. On the other hand, a data drive circuit receives a data signal and a clock signal and is controlled by the driver signal and the latch signal so as to drive a number of data electrodes of the display panel. The data drive circuit is composed of for example a driver, a latch and a shift register. The clock signal is a dot clock in synchronism with the data signal.

With the above arrangement, the display panel is driven in a line sequential scanning manner from a first line to a final line in accordance with the horizontal synchronizing signal, and this scanning is repeated 7ith reference to the vertical synchronizing signal. For this purpose, during one period of the horizontal synchronizing signal, a number of items of data corresponding to display cells of one scan line are serially supplied to the shift register of the data drive circuit in synchronism with the clock signal, and after the data has been written to the shift register, a content of the shift register is transferred from a parallel output of the shift register to the latch. The display cells on one scan line selected by the scan drive circuit is energized or deenergized by the driver of the data drive circuit on the basis of the data held in the latch during one period of the horizontal synchronizing signal, namely, in one scanning period.

The above mentioned conventional display apparatus is such that the data signals are serially transferred to the shift register. Therefore, since a required frequency of the clock signal and the data signal increases in proportion with increase of a display capacity, the shift register having a high operating frequency has been required.

SUMMARY OF THE INVENTION

Accordingly, it is an object of the present invention to provide a display apparatus which has overcome the above mentioned defect of the conventional one.

Another object of the present invention is to provide a data drive circuit for use in a dynamic drive type display apparatus, which has a large display capacity but can use a shift register having a low operating frequency.

The above and other objects of the present invention are achieved in accordance with the present invention by a display apparatus so configured that a display voltage is sequentially applied to scan electrodes from a scan drive circuit, and data items corresponding to the number of cells of one scan line are transferred to a shift register, and after completion of the data transfer, all data of the shifter register is shifted to a latch, so that a voltage determining energization/deenergization of a display cell is applied from a data drive circuit in accordance with data latched in the latch, the display apparatus being characterized in that the data drive circuit is divided into a plurality of data drive sub-circuits, and data of one scan to be transferred to a shifter register of each of the data drive sub-circuits is stored in a memory circuit once, and thereafter, simultaneously transferred in parallel to the shift registers of all the data drive sub-circuits.

In a preferred embodiment, the matrix display apparatus includes:

a display panel having a number of scan electrodes, a number of data electrodes and a number of display cells formed at intersections between the scan electrodes and the data electrodes;

scan drive means receiving a vertical synchronizing signal and a horizontal synchronizing signal for sequentially driving the scan electrodes;

data drive means including at least shift register means and for driving the data electrodes on the basis of a content of the shift register means, the shift register means includes a plurality of shift registers each /f which has a serial data input;

memory means including a corresponding number of memories each of which has a data input receiving a data signal in common and a data output connected to the serial data input of a corresponding one of the shift registers; and control means receiving a clock signal for controlling the memories and the shift registers so that the data signal is sequentially distributed to the memories and the respective data signals stored in the memories are simultaneously supplied to all the shift registers.

More specifically, the control means includes a signal control circuit receiving the vertical synchronizing signal and the horizontal synchronizing signal for generating a data transfer signal, which is supplied in parallel to the shift registers as a write control signal and is also supplied in parallel to the memories as a read control signal, and a clock division circuit receiving the clock signal for generating a corresponding number of frequency-divided clocks which are different in phase from one another and each of which is supplied to a corresponding one of the memories as a write control signal.

The above and other objects, features and advantages of the present invention will be apparent from the following description of preferred embodiments of the invention with reference to the accompanying drawings.

DESCRIPTION OF THE PREFERRED EMBODIMENTS

Figure 1:
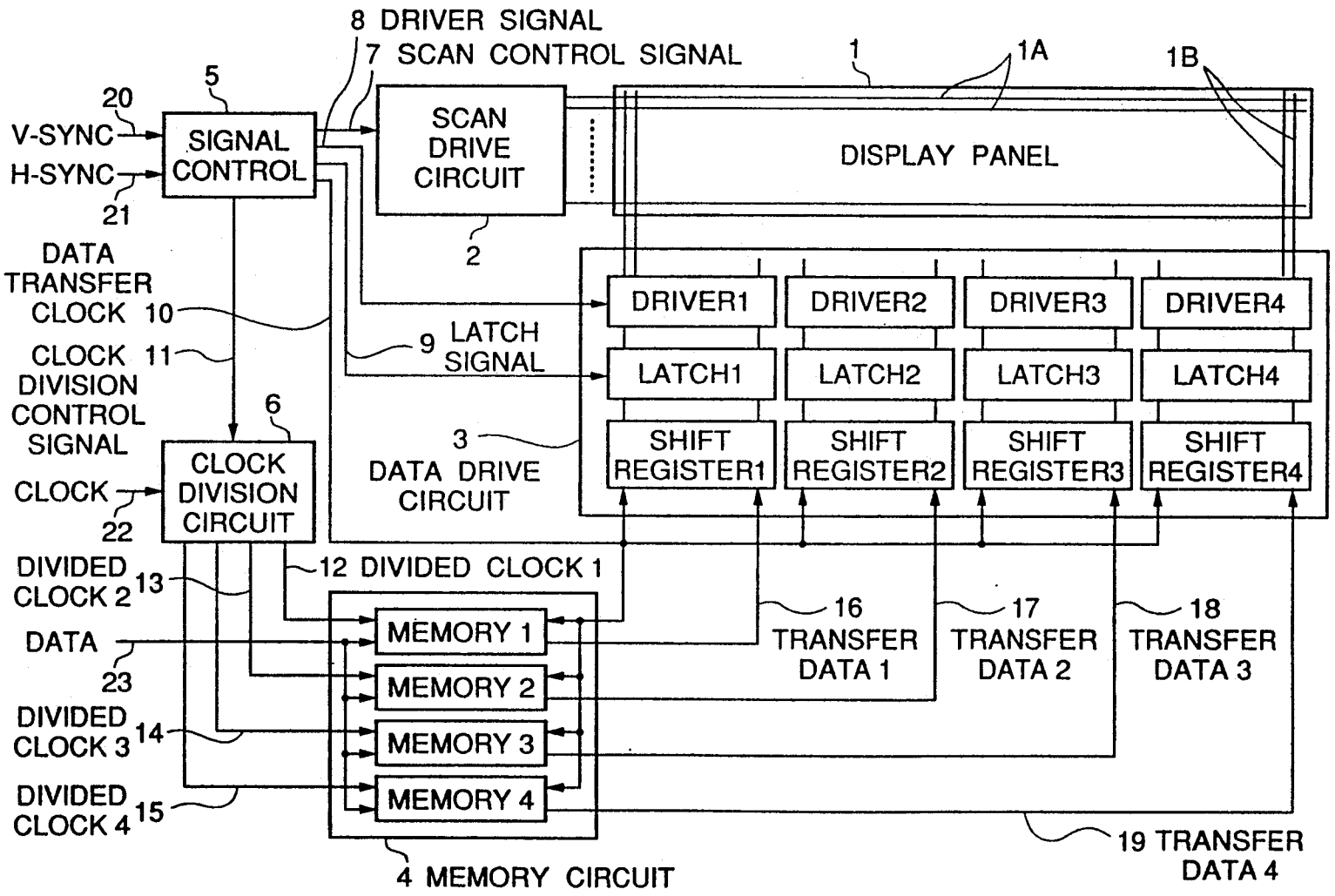
FIG. 1 is a block diagram showing one embodiment of the matrix display apparatus in accordance with the present invention.

Referring to FIG. 1, there is shown a block diagram showing one embodiment of the dynamic drive type matrix display apparatus in accordance with the present invention.

The shown dynamic drive type matrix display apparatus includes a signal control circuit 5 which receives a vertical synchronizing signal 20 and a horizontal synchronizing signal 21 and generates a scan control signal 7, a driver signal 8, a latch signal 9, a data transfer clock 10 and a clock division control signal 11. In response to the scan control signal 7, a scan drive circuit 2 sequentially drives a number of scan electrodes 1A of a display panel 1. On the other hand, a data drive circuit 3 receives the driver signal 8, the latch signal 9 and the data transfer clock 10 and also receives data from a memory circuit 4 for driving a number of data electrodes 1B of the display panel 1. Display cells are constituted in intersections between the scan electrodes 1A and the data electrodes 1B.

The shown embodiment also includes a clock division circuit 6 which receives a clock signal 22 and a clock division control signal 11 and which time-divides the clock signal 22 into four divided clock signals 12 to 15 labelled with "DIVIDED CLOCK 1" to "DIVIDED CLOCK 4" on the basis of the clock division control signal. These divided clock signals 12 to 15 are different in phase from one another.

A memory circuit 4 includes four memories labelled with "MEMORY 1" to "MEMORY 4". A data signal 23 is connected in parallel to the four memories "MEMORY 1" to "MEMORY 4", which also receive the four divided clock signals 12 to 15, respectively, as a write control signal. Therefore, the data signal 23 is distributed and written into memories "MEMORY 1" to "MEMORY 4" in response to the divided clock signals 12 to 15.

The four memories "MEMORY 1" to "MEMORY 4" also receive the data transfer clock 10 as a read control signal, so that four transfer data 16 to 19 labelled with "TRANSFER DATA 1" to "TRANSFER DATA 4" are simultaneously read from the four memories "MEMORY 1" to "MEMORY 4" in response to the data transfer clock 10.

The data drive circuit 3 includes four data drive sub-circuits, each of which includes one driver, one latch and one shift register. In the drawing, the driver, the latch and the shift register of a first data drive sub-circuit are labelled with "DRIVER 1", "LATCH 1" and "SHIFT REGISTER 1", respectively. In a second data drive sub-circuit, the driver, the latch and the shift register are labelled with "DRIVER 2", "LATCH 2" and "SHIFT REGISTER 2", respectively. In a third data drive sub-circuit, the driver, the latch and the shift register are labelled 7ith "DRIVER 3", "LATCH 3" and "SHIFT REGISTER 3", respectively. In a fourth data drive sub-circuit, the driver, the latch and the shift register are labelled with "DRIVER 4", "LATCH 4" and "SHIFT REGISTER 4", respectively. The driver signal 8 is supplied to the drivers of all the first to fourth data drive sub-circuits, and the respective drivers of the first to fourth data drive sub-circuits are simultaneously drive all the data electrodes 1B of the display panel 1 in parallel. The latch signal 9 is also supplied to the latches of all the first to fourth data drive sub-circuits, and the data transfer clock 10 is supplied as a write control signal to the shift registers of all the first to fourth data drive sub-circuits, which are connected to receive at their serial input a corresponding one of the four transfer data "TRANSFER DATA 1" to "TRANSFER DATA 4".

With the above mentioned arrangement, the serially supplied data signal 23 is distributed by the divided clock signals 12 to 15 "DIVIDED CLOCK 1" to "DIVIDED CLOCK 4" to the four memories "MEMORY 1" to "MEMORY 4" corresponding to the four shift registers "SHIFT REGISTER 1" to "SHIFT REGISTER 4". Thus, the data for the shift register 1 is stored in the memory 1, and the data for the shift register 2 is stored in the memory 2. In addition, the data for the shift register 3 is stored in the memory 3, and the data for the shift register 4 is stored in the memory 4. The data stored in the memories 1 to 4 is simultaneously read out in response to the data transfer clock 10, so as to constitute the transfer data 16 to 19. Therefore, the frequency of the transfer to the shift registers "SHIFT REGISTER 1" to "SHIFT REGISTER 4" is determined by the data transfer clock 10. Since the data signal 23 is converted or distributed into four parallel bits of the transfer data 1 to 4, the data transfer clock 10 can be made to one fourth of the frequency of the clock signal 22.

Figure 2:
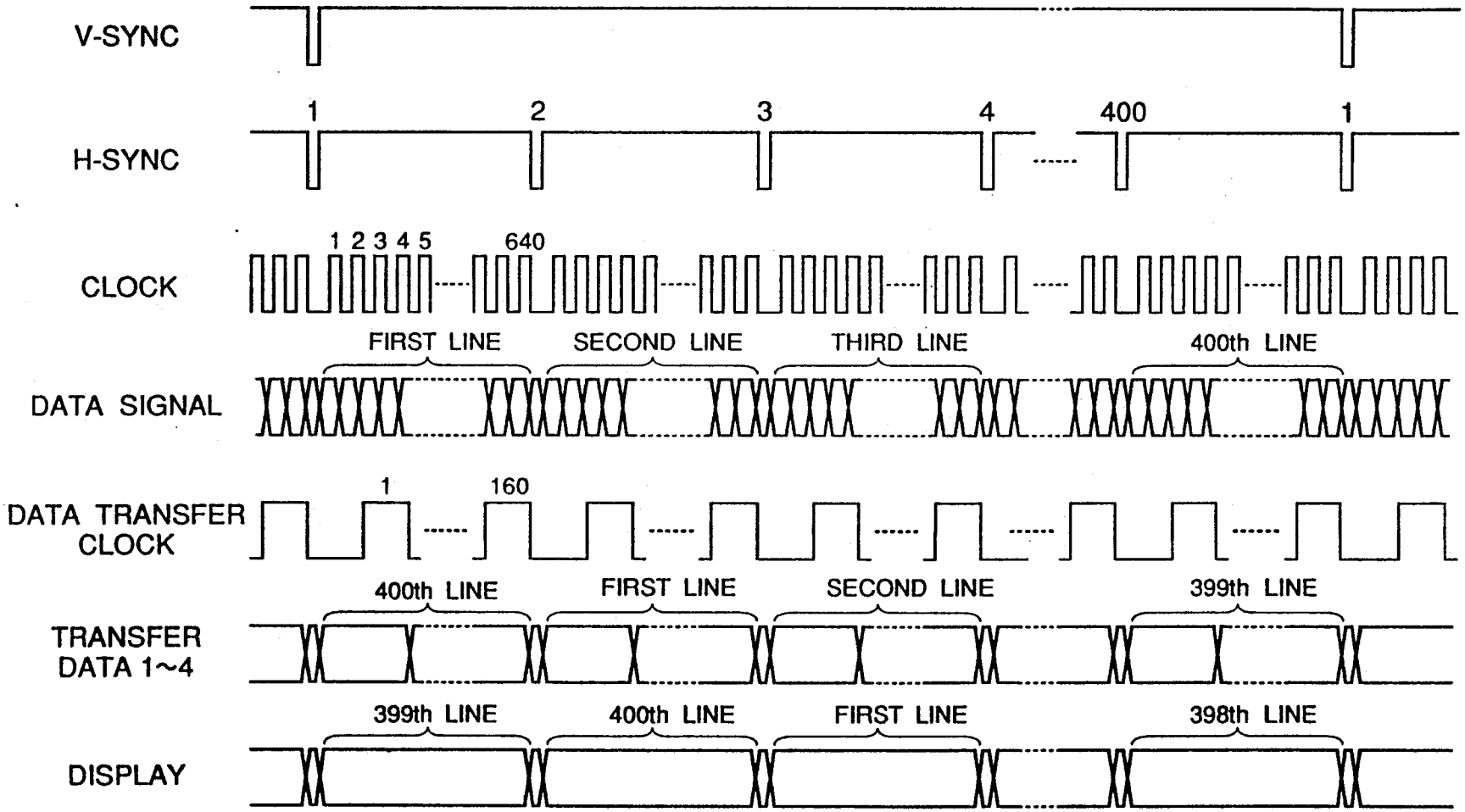
FIG. 2 is a timing chart illustrating an operation of the embodiment shown in FIG. 1, in the case of having the display capacity of 640×400 dots.

FIG. 2 shows a timing chart illustrating a relation between the input signal, the data transfer clock, the transfer data 1 to 4, and the display in the embodiment having the display capacity of 640×400 dots. During each one period of the horizontal synchronizing signal, there exist the data transfer clocks of 160 pulses which is one fourth of 640. Therefore, the data transfer clock has a frequency obtained by frequency-dividing the clock signal. The transfer data 1 to 4 is the signals read out from the memory circuit 4 after the data signals had been stored once in the memory circuit 4, and therefore, is delayed from the data signal by one period of the horizontal synchronizing signal. Accordingly, the display is performed with a further delay corresponding to one period of the horizontal synchronizing signal.

Figure 3:
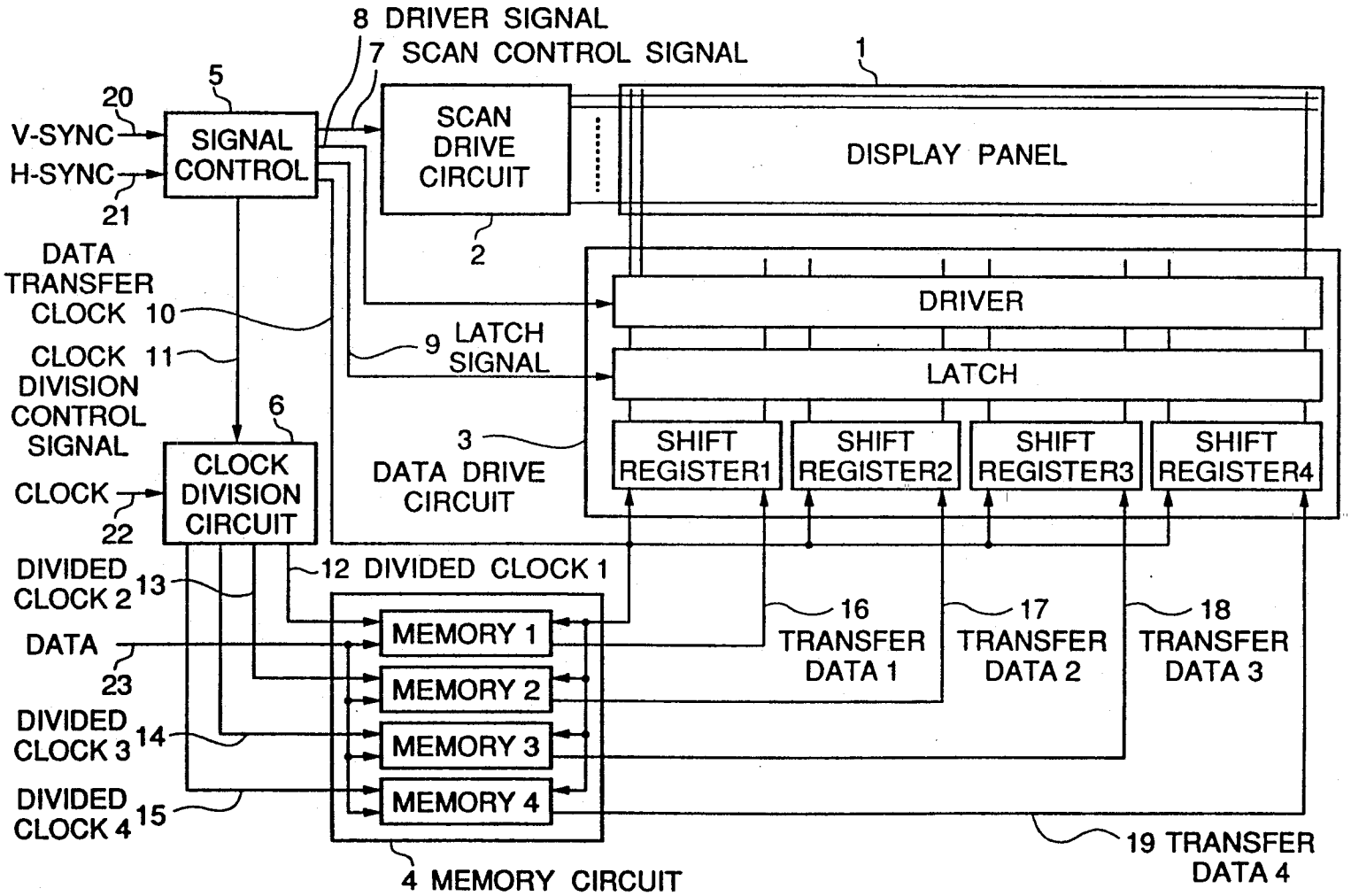
FIG. 3 is a block diagram showing another embodiment of the matrix display apparatus in accordance with the present invention.

Referring to FIG. 3, there is shown a block diagram showing another embodiment of the matrix display apparatus in accordance with the present invention. In FIG. 3, elements similar to those shown in FIG. 1 are given the same Reference Numerals, and explanation thereof will be omitted.

As seen from comparison between FIGS. 1 and 3, the second embodiment is characterized in that the four drivers "DRIVER 1" to "DRIVER 4" and the four latches "LATCH 1" to "LATCH 4" are replaced with one driver "DRIVER" and one latch "LATCH", respectively.

In the present invention, it is important that the shift register of the data drive circuit is divided into a plurality of shift registers which can receives different data signals in parallel. Therefore, the second embodiment operates similarly to the first embodiment.

As mentioned above, the present invention can lower the transfer rate of the data to the shift register of the data drive circuit, since the data drive circuit has a plurality of shift registers, and since there is provided a converting circuit used for transferring the data into respective shift registers in parallel. In addition, if the frequency-dividing number for the data transfer rate is made lower than the dividing number of the data drive circuit, namely, the number of the shift registers, the processing time for transferring data to the shift registers can be lowered.

The invention has thus been shown and described with reference to the specific embodiments. However, it should be noted that the present invention is in no way limited to the details of the illustrated structures but changes and modifications may be made within the scope of the appended claims.

I claim:

1. A matrix display apparatus comprising:

a display panel having a number of scan electrodes, a number of data electrodes and a number of display cells formed at intersections between said scan electrodes and said data electrodes;

scan drive means receiving a vertical synchronizing signal and a horizontal synchronizing signal for sequentially driving said scan electrodes;

data drive means including at least shift register means and driving said data electrodes on the basis of a content of said shift register means, said shift register means including a plurality of shift registers each of which has a serial data input;

memory means including a corresponding number of memories each of which has a data input receiving a data signal in common and a data output connected to said serial data input of a corresponding one of said shift registers; and control means receiving a clock signal for controlling said memories and said shift registers so that said data signal is sequentially distributed to said memories and the respective data signals stored in said memories are simultaneously supplied to all said shift registers, wherein said control means includes a signal control circuit receiving said vertical synchronizing signal and said horizontal synchronizing signal for generating a data transfer signal which is supplied in parallel to all said shift registers as a write control signal and is also supplied in parallel to said memories as a read control signal, and a clock division circuit receiving said clock signal for generating a corresponding number of frequency-divided clocks which are different in phase from one another and each of which is supplied to a corresponding one of said memories as a write control signal.

2. A dynamic drive type matrix display apparatus comprising:

a display panel (1) including a number of scan electrodes (1A), a number of data electrodes (1B) and a number of display cells formed at intersections between said scan electrodes and said data electrodes;

a signal control circuit (5) receiving a vertical synchronizing signal and a horizontal synchronizing signal and generating a scan control signal, a driver signal, a latch signal, a data transfer clock and a clock division control signal;

a scan drive circuit (2) connected to said display panel and said signal control circuit (5) and receiving said scan control signal to sequentially drive said scan electrodes of said display panel in response to said scan control signal;

a clock division circuit (6) receiving a clock signal and being connected to said signal control circuit (5) for receiving therefrom said clock division control signal for time-dividing said clock signal into a plurality of divided clock signals on the basis of said clock division control signal, said divided clock signals being different in phase from one another;

a memory circuit (4) including a corresponding number of memories which are connected in parallel with each other to receive in common a data signal, each of said memories receiving a corresponding one of said divided clock signals as a write control signal, so that said data signal is distributed and written into said memories in response to said divided clock signals, each of said memories also receiving from said signal control circuit (5) said data transfer clock as a read control signal, so that a corresponding number of transfer data are simultaneously read from said memories in response to said data transfer clock;

a data drive circuit (3) connected to said signal control circuit (5) for receiving said driver signal, said latch signal and said data transfer clock therefrom and also receiving said corresponding number of transfer data from said memory circuit (4), said data drive circuit (3) including a number of driver means, a corresponding number of latch means, and a corresponding number of shift registers, which are so connected, respectively, that said driver signal is supplied to said driver means such that said driver means simultaneously drive all said data electrodes of said display panel on the basis of corresponding contents of said latch means, and said latch signal is also supplied to said latch means so that said latch means simultaneously latch contents of all said shift registers in parallel, each of said shift registers being connected to a respective memory of said memory circuit to receive at a serial input thereof a corresponding one of said transfer data, and said data transfer clock being supplied from said signal control circuit (5) as a write control signal to all said shift registers so that said corresponding number of transfer data simultaneously read from said memories are simultaneously fetched and shifted in said shift registers, respectively, in parallel, in response to said data transfer clock.

3. A dynamic drive type matrix display comprising:

a display panel (1) having a number of scan electrodes, a number of data electrodes and a number of display cells formed at intersections between said scan electrodes and said data electrodes;

a signal control circuit (5) receiving a vertical synchronizing signal and a horizontal synchronizing signal and generating a scan control signal, a driver signal, a latch signal, a data transfer clock and a clock division control signal;

a scan drive circuit (2) connected to said display panel (1) and said signal control circuit (5) and receiving said scan control signal to sequentially drive said scan electrodes of said display panel (1) in response to said scan control signal;

a clock division circuit (6) receiving a clock signal and being connected to said signal control circuit (5) for receiving said clock division control signal for time-dividing clock signal into a plurality of divided clock signals on the basis of said clock division control signal, said divided clock signals being different in phase from one another;

a memory circuit (4) including a corresponding number of memories which are connected in parallel with each /ther to receive in common a data signal, each of said memories receiving a corresponding one of said divided clock signals as a write control signal, so that said data signal is distributed and written into said memories in response to said divided clock signals, each of said memories also receiving said data transfer clock from said signal control circuit (5) as a read control signal, so that a corresponding number of transfer data are simultaneously read from said memories in response to said data transfer clock, the whole of said corresponding number of memories being capable of storing said data signal of the amount corresponding to one scan line of said display panel (1);

a data drive circuit (3) connected to said display panel (1), said control circuit (5) and said memories of said memory circuit (4) and receiving said driver signal, said latch signal and said data transfer clock from said signal control circuit (5) and also receiving said corresponding number of transfer data from said memory circuit (4), said data drive circuit (3) including driver means, latch means and a number of shift registers, which are so connected that said driver signal is supplied to said driver means such that said driver means simultaneously drives all said data electrodes of said display panel (1) on the basis of corresponding contents of said latch means and said latch signal is also supplied to said latch means so that said latch means simultaneously latches contents of all said shift registers in parallel, each of said shift registers being connected to receive at a serial input thereof a corresponding one of said transfer data, the whole of said number of shift registers being capable of storing said data signal of the amount corresponding to one scan line of said display panel (1), and said data transfer clock being supplied as a write control signal to all said shift registers so that said corresponding number of transfer data simultaneously read from said memories are simultaneously fetched and shifted in said shift registers, respectively, in parallel, in response to said data transfer clock, wherein when said data signals of one scan line are stored in said memory circuit, said data signals of one scan line just before said data signals of one scan line stored in said memory circuit are stored in the whole number of said shift registers, and said data signals of one scan line just before said data signals of one scan line stored in the whole number of said shift registers are displayed on said display panel.

* * * * *